US008215876B2

(12) United States Patent
Onsori et al.

(10) Patent No.: US 8,215,876 B2
(45) Date of Patent: Jul. 10, 2012

(54) SHIELD CAP FOR A SHIELD-TYPE MINING SUPPORT

(75) Inventors: Siamak Onsori, Dortmund (DE); Stefan Hengstler, Lunen (DE); Detlef Hahn, Lunen (DE); Sebastian M. Mundry, Ludinghausen (DE); Detlev Lettau, Dortmund (DE)

(73) Assignee: Caterpillar Global Mining Europe GmbH, Lünen (DE)

( * ) Notice: Subject to any disclaimer, the term of this patent is extended or adjusted under 35 U.S.C. 154(b) by 36 days.

(21) Appl. No.: 12/999,604

(22) PCT Filed: Jun. 19, 2009

(86) PCT No.: PCT/IB2009/052636

§ 371 (c)(1),
(2), (4) Date: Jan. 25, 2011

(87) PCT Pub. No.: WO2009/153760

PCT Pub. Date: Dec. 23, 2009

(65) Prior Publication Data

US 2011/0142551 A1 Jun. 16, 2011

(30) Foreign Application Priority Data

Jun. 20, 2008 (DE) ..... 10 2008 029 085

(51) Int. Cl.
*E21D 23/06* (2006.01)

(52) U.S. Cl. ..... 405/288; 405/291; 405/290

(58) Field of Classification Search ..... 405/288, 405/290, 291, 292, 293, 294, 295, 296, 297, 405/298, 299, 300, 301, 302
See application file for complete search history.

(56) References Cited

U.S. PATENT DOCUMENTS

| | | | | |
|---|---|---|---|---|
| 3,383,866 | A | 5/1968 | Groetschel | |
| 3,399,927 | A | 9/1968 | Groetschel | |
| 3,872,678 | A | 3/1975 | Shuttleworth | |
| 4,347,021 | A * | 8/1982 | Elsner et al. | 405/293 |
| 4,449,860 | A * | 5/1984 | Becker et al. | 405/293 |
| 4,573,828 | A | 3/1986 | Jones et al. | |
| 4,609,308 | A * | 9/1986 | Hill et al. | 405/293 |
| 4,792,261 | A * | 12/1988 | Bithell | 405/293 |
| 5,626,441 | A * | 5/1997 | Grebenyuk | 405/293 |

FOREIGN PATENT DOCUMENTS

| | | | |
|---|---|---|---|
| DE | 198 14 246 | A1 | 10/1999 |
| GB | 773407 | A | 4/1957 |
| GB | 2260558 | A * | 4/1993 |

* cited by examiner

*Primary Examiner* — Frederic L Lagman
(74) *Attorney, Agent, or Firm* — Rankin, Hill & Clark LLP

(57) ABSTRACT

A shield cap for a shield-type support for underground mining includes a cap plate, with reception devices for the connection of hydraulic cylinder heads to the shield cap, and a supporting structure welded below the cap plate and having a plurality of longitudinal spars. At least two of the longitudinal spars include substantially I-profile struts having an upper profile chord, a lower profile chord and a middle chord running perpendicularly to the two profile chords. The distance between the upper and the lower profile chord decreases at least over a part length of each strut.

21 Claims, 5 Drawing Sheets

Fig.7
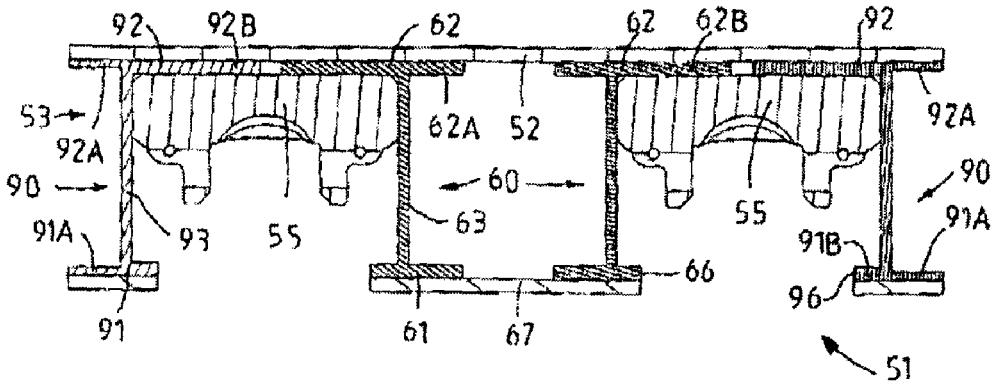
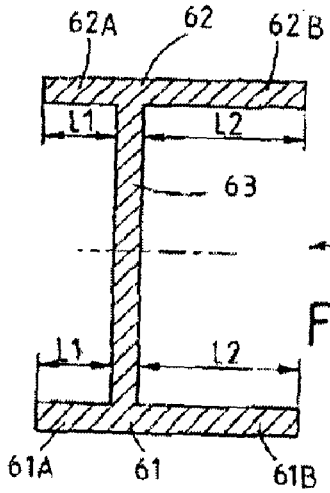
Fig.8
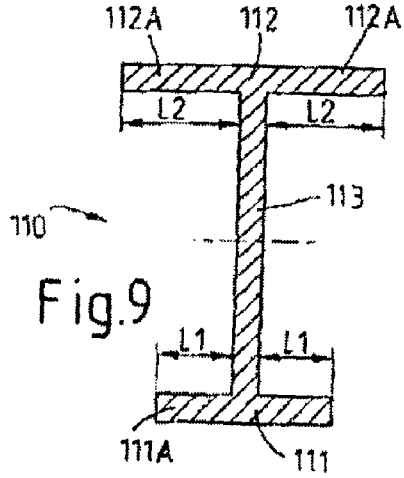
Fig.9
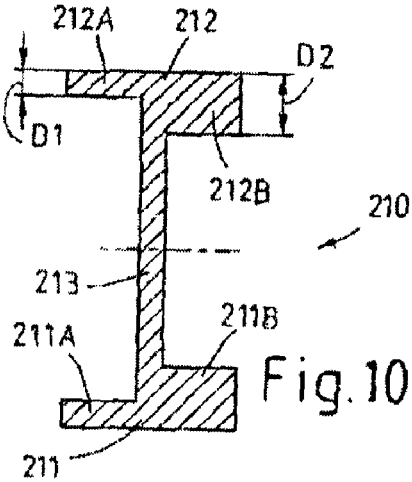
Fig.10
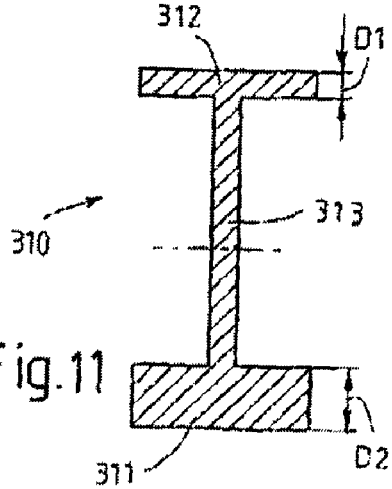
Fig.11

SHIELD CAP FOR A SHIELD-TYPE MINING SUPPORT

This application claims priority to and the benefit of the filing date of International Application No. PCT/IB2009/052636, filed 19 Jun. 2009, which application claims priority to and the benefit of the filing date of German Application No. 10 2008 029 085, filed 20 Jun. 2008, both of which are hereby incorporated by reference into the specification of this application.

BACKGROUND

The present invention relates to a shield cap for a shield-type mining support or a shield support for underground mining. The shield cap or shield support includes a cap plate, with reception devices for the connection of hydraulic cylinder heads to the shield cap, and a supporting structure welded below the cap plate and having a plurality of longitudinal spars.

Shield supports, the height of which is variable by means of hydraulic cylinders, have been used for decades in underground mining and, as a rule, have two floor runners, a link mechanism, an impact shield and a one-part or multipart shield cap connected to the impact shield in an articulated manner. By the mostly two, sometimes even four hydraulic cylinders being extended, the shield cap is pressed against what is known as the hanging roof, that is to say the top rock, of an underground longwall face, in order to keep free in the underground rock a chamber, mostly designated as a longwall face, for arranging the mining machines. A plurality of shield supports or shield support frameworks of adjustable height form a self-advancing support which, by the hydraulic cylinders being retracted and by individual shield supports being moved along, can be drawn forward via approximately horizontally oriented advancing cylinders braced against the mining plant, or via which a mining plant can be pushed forward.

The shield support frameworks or shield supports used in high-performance mining operations comprise shield caps, the cap plates of which have lengths of five meters and more and widths of two meters and more. By means of the supporting structure welded below the cap plate, in this case all the bending forces between the cap tip and the cap end or the reception devices for the ram heads have to be absorbed with high reliability, in order to avoid a fracture of the shield cap given the case of loose or undulating rock against which the shield cap is pressed. In order to withstand these loads, the shield support frameworks used at the present time mostly have a supporting structure produced in a box type of a construction and having a multiplicity of longitudinal spars which consist of sheet metal strips and which are stiffened via transverse plates. In a shield support with a draw-off orifice, such as is described, for example, in DE 198 14 246 A1, two box profile-shaped longitudinal spars are provided which extend over the entire length of the shield cap and at the same time form the guide device for a sliding plate in order to provide the openable and closable draw-off orifice in the shield cap for the draw-off extracting method.

BRIEF DESCRIPTION

One object of the present invention is to provide a shield cap which can be produced at less outlay and with lower weight and at the same time has a higher bending strength than the known constructions.

This and further objects are achieved, according to one exemplary embodiment of the present invention, in that at least two of the longitudinal spars include substantially I-profile struts, that is to say of profile struts with a substantially I-shaped cross section on account of an upper profile chord, a lower profile chord and a middle chord running perpendicularly to the two profile chords. The distance between the upper and lower profile chord decreases at least over a part length of the profile strut. In the solution according to the present invention, essentially, a box type of construction of a multiplicity of sheet metal strips or box profiles welded to one another is dispensed with, and, instead, profile struts of substantially I-shaped cross section are employed, of which the height, therefore also their bending strength, vary over the length of the shield cap. With this construction, the shield cap has a higher bending and torsional strength in the regions subjected to higher load around the reception devices than in those regions, for example near the cap tip, in which lower loads occur. The use of substantially I-profile struts as longitudinal spars makes it possible to have a supporting structure with higher bending strength, at the same time with reduced weight, and, because of the use of profile struts with an integrated upper and lower profile chord and middle chord, a considerable reduction in the weld seams required for producing the welded supporting structure can also be achieved at the same time.

In the particularly embodiment, the upper profile chord and the lower profile chord extend in each case on both sides of the middle chord in each case with a chord leg. Depending on the intended use of the shield cap or of the shield support equipped with this and on the dimensions of the shield cap, substantially I-profile struts may be used in which the upper and the lower profile chord have width and thickness dimensions identical to one another, and/or profile struts may be used in which the upper and the lower profile chord have different width dimensions and/or different thickness dimensions. In a shield cap with more than two longitudinal spars, profile struts with identically dimensioned profile chords may also be used with profile struts having differently dimensioned profile chords as a supporting structure.

The substantially I-profile struts used may be designed mirror-symmetrically to the longitudinal mid-plane of the middle chord. Alternatively, the chord legs of the substantially I-profile struts used on one side of the middle chord may have a greater thickness and/or a greater width than the chord legs on the other side. On a shield cap with more than two longitudinal spars, both mirror-symmetrical profile struts and middle struts with a cross section which is designed asymmetrically to the middle chord may be employed in order to achieve an optimized ratio of bending strength to weight by the choice of different profile cross sections. For this purpose, in each case, the more strongly dimensioned portions of the profile struts should be arranged in those regions which have to absorb higher loads.

It can be particularly advantageous if the lower chord legs are provided partially with clearances in the region of the reception devices for the hydraulic cylinder heads. Depending on the dimensions of the reception device and the dimensions of the chord legs of the lower profile chord, the clearances may extend as far as the middle chord or the clearances reduce the width of the respective chord leg only to a narrow leg web remaining in the middle chord and still projecting. The weakening of the bending strength caused by the clearances in the lower profile chord can be compensated, inter alia, by virtue of the fact that the reception devices are welded to the chord legs of the upper profile chords above the clearances.

According to one alternative exemplary embodiment, the lower profile chord may extend only on one side of the middle chord with a lower chord leg, the thickness of which is greater than the thickness of the middle chord and the thickness of the profile chords of the upper profile chord. Owing to the considerable increase in thickness of the lower chord leg which is formed on only one side and, in the mounted state, is arranged in such a way that, in the case of two adjacently arranged substantially I-profile struts, the lower profile chord in each case projects outward with respect to the adjacently lying middle chords, a profile cross section can be provided on which no reworking, such as clearances and the like, is required in order to attach the reception devices for the cylinder heads. The thickness of the one-sided lower chord leg is approximately twice as great or more than twice as great as the thickness of the middle chord or of the upper profile chord.

According to yet a further alternative exemplary embodiment, two substantially I-profile struts may be combined into a longitudinal carrying spar with a substantially Π (PI) profile, in that the upper profile chords of two profile struts are welded to one another or two middle chords spaced apart from one another by the amount of an interspace are provided integrally on an upper profile chord. The longitudinal spars or longitudinal carrying spars consequently consist integrally of two substantially I-profile struts, in the substantially Π-profile the profile thickness in the upper chord, in both middle chords and in all the chord legs of the lower chord preferably being constant, consequently being identical throughout. For a shield cap, it can be in this case particularly advantageous if overall two longitudinal carrying spars with a Π-profile are provided.

In order to withstand alternating loads with the shield cap, it can be particularly advantageous if the upper profile chords of all the profile struts are welded to the underside of the cap plate via longitudinal weld seams. If the cross section of the upper profile chord is uniform over the length, the longitudinal weld seams can be applied relatively simply both by means of robots and by hand and at high speed.

As already stated further above, the number of substantially I-profile struts used in the supporting structure may vary. In the case of some shield supports, it may be sufficient to use two appropriately strongly dimensioned substantially I-profile struts. In the particularly embodiment, four longitudinal spars consisting of substantially I-profile struts are employed as a supporting structure, in which case it can be particularly advantageous if the two inner substantially I-profile struts, on the one hand, and the two outer profile struts, on the other hand, are in each case arranged or designed mirror-symmetrically to the longitudinal mid-axis of the shield cap, so that by means of the shield cap the same forces can be absorbed or supported uniformly on both sides of the longitudinal mid-axis.

The reception device for the hydraulic cylinder heads may comprise, in particular, a cast bearing trough which is welded to mutually confronting chord legs of adjacent profile struts. Corresponding bearing troughs can be prefabricated with high dimensional accuracy and can be anchored within the supporting structure at low outlay. For the same reasons, it can be advantageous, furthermore, if pivot joints consisting of cast parts are welded to the rear end of the shield cap, in which case the pivot joints preferably have a base part which is welded in between the upper and lower profile chord of adjacently lying profile struts. The base parts of the pivot joints can at the same time bring about an additional stiffening of the upper and lower profile chords at the rear end of the shield cap.

If the substantially I-profile struts are used as longitudinal spars within the supporting structure, it can be particularly advantageous if these have, as seen over the length, a middle chord which in the rear region of the shield cap has a zone of constant height followed by a zone in which the height of the middle chord decreases at a higher gradient and subsequently has a zone in which the height of the middle chord decreases with a lower gradient. This may be achieved, for example, by means of an oblique run of the lower profile chord to the upper profile chord of about 2-6° in one zone and of about 10-12° in the other zone. The bearing trough and the pivoted joints are arranged or welded in that region of the profile struts in which the middle chord has the zone of constant height. This zone of the middle chord is about twice as long as the other two zones of changing heights in each case, each profile strut extending with the maximum distance between the profile chords over the entire rear region of the shield cap, in which region the connection parts of the supporting devices, such as, in particular, the bearing troughs and the pivot joints, are arranged and in which the highest loads occur. The depth of the shield cap and, correspondingly, the distance between the upper and lower profile chord likewise decrease with a decreasing load, as a result of which a weight reduction or weight optimization is achieved at the same time.

Each profile strut with the changing height distance between the upper and lower profile chord may be produced from or consist of a cast basic profile. It can be particularly advantageous, however, if the basic profiles are produced from a drawn or, even more advantageously, a rolled basic profile with a constant distance between the upper and lower profile chord, consequently from a basic profile which is obtainable as yardage goods and in which the middle chord is partially separated in the lower region, a portion of the middle chord is separated out and the lower profile chord is pressed or rolled onto the separation edge, having occurred during separating out, and is welded there again. Such specially adapted substantially I-profile struts with a cross-sectional profile changing over the length and adapted to the loads can be produced relatively cost-effectively, in spite of the profile form varying over the length, and can at the same time be adapted optimally to the expected loads. For additional stiffening, supporting plates may be welded in between the chord legs of the upper and of the lower profile chord. Corresponding supporting plates may be welded, in particular, to the outsides of the substantially I-profile struts forming the outer longitudinal spars, so that closing-off plates or the like can be welded on further outward, by means of which the shield cap acquires an essentially closed cavity in which the supporting structure is arranged. It can be particularly advantageous if at least one underplate provided with longitudinal slots for the application of connecting weld seams is welded to the underside of the lower profile chord. In which case, for the further reduction in manufacturing costs, a plurality of underplates can be welded on, and can be distributed over the length. With one underplate per zone, manufacture is particularly simple.

Further advantages and embodiments of a shield cap according to the present invention may be gathered from the following description of exemplary embodiments, shown in the drawing, of the set-up of a shield cap and of different profile forms of the substantially I-profile struts which can be used in the supporting structure.

BRIEF DESCRIPTION OF THE FIGURES

FIG. 7 shows diagrammatically a sectional view, similar to FIG. 4, through a shield cap according to a second exemplary embodiment;

FIG. 8 shows the profile cross section of the inner substantially I-profile struts used in the exemplary embodiment according to FIG. 7;

FIG. 9 shows a third exemplary embodiment of a profile cross section, which can be used advantageously in shield caps, of a profile strut;

FIG. 10 shows a fourth exemplary embodiment of a profile cross section of a substantially I-profile strut;

FIG. 11 shows a fifth exemplary embodiment of the profile cross section of a substantially I-profile strut which can be used in a shield cap according to the invention;

DETAILED DESCRIPTION

Figure 1:
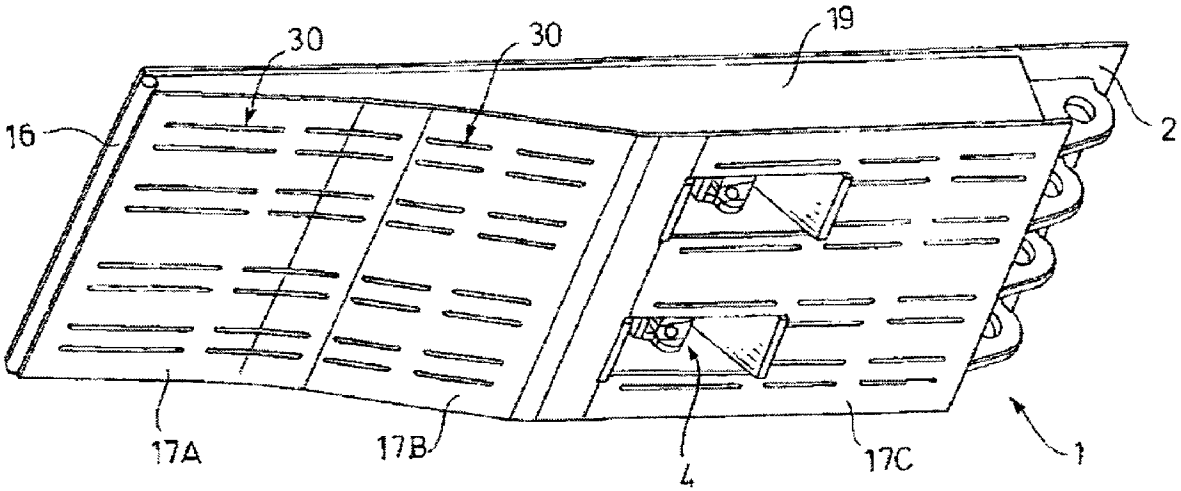
FIG. 1 shows a shield cap according to the present invention, in perspective view from below.

Referring now to the drawings wherein the showings are for the purpose of illustrating exemplary embodiments of the present invention only and not for the purpose of limiting same, FIG. 1 shows a diagrammatically simplified view of a shield cap 1 according to the present invention for use on a shield support framework of any desired construction with floor runners, hydraulic rams, an impact shield and a link mechanism, so that the shield cap 1 can be pressed in a way known per se against the hanging roof of an underground coal mining longwall face or the top rock of an underground cavity by means of the hydraulic cylinders. As is also shown particularly in the exploded illustration in FIG. 2, the shield cap 1 has an upper cap plate 2 which consists here of a one-piece continuous strong plate and below which is welded a supporting structure, designated as a whole by reference symbol 3, which is formed from here four substantially I-profile struts 10 arranged next to one another and extending over the entire length of the shield cap 1. The profile struts of substantially I-shape cross section which extend over the length of the shield cap 1 form the carrying elements of the shield cap 1 into which essentially all the forces are introduced and which give the shield cap 1 particularly high bending and torsional strength due to their profile form.

Figure 3:
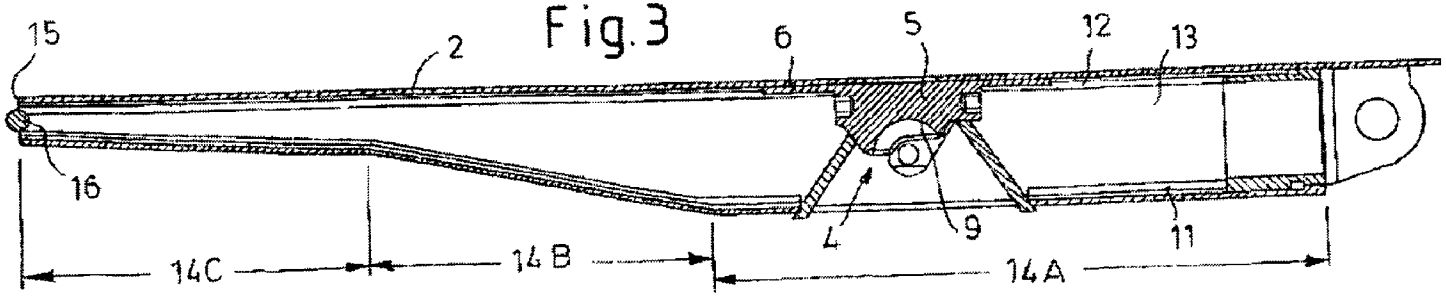
FIG. 3 shows a longitudinal section through the shield cap according to FIG. 1.
Figure 5:
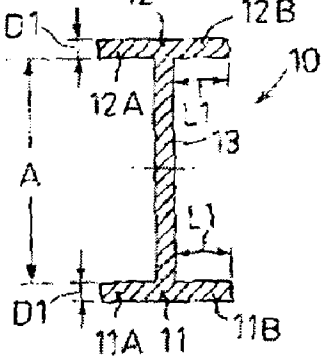
FIG. 5 shows the cross-sectional profile of the substantially I-profile struts in the shield cap according to FIG. 1.

FIG. 3 shows a side view of one of the substantially I-profile struts 10 in a longitudinal section through the shield cap 1, and FIG. 5 shows the basic profile cross section of these substantially I-profile struts 10. It is clearly evident from FIG. 5 that, in the exemplary embodiment of the shield cap 1, each substantially I-profile strut 10 has a lower profile chord 11, an upper profile chord 12 running parallel thereto and at a distance therefrom and a middle chord 13 running perpendicularly to the two profile chords 11, 12. The lower profile chord 11 has on each of the two sides of the middle chord 13 a chord leg 11A, 11B angled perpendicularly to the latter, and the upper profile chord 12 has in the same way, on each of the two sides, an upper chord leg 12A, 12B. The substantially I-profile strut 10 has approximately a constant thickness D1 both in the middle chord 13 and in both profile chords 11, 12, and the chord legs 11A, 11B, 12A, 12B in each case project on both sides beyond the middle chord 13 by the same width L1. The substantially I-profile strut 10 is consequently designed symmetrically to a longitudinal plane passing through the middle chord 13.

Figure 2:
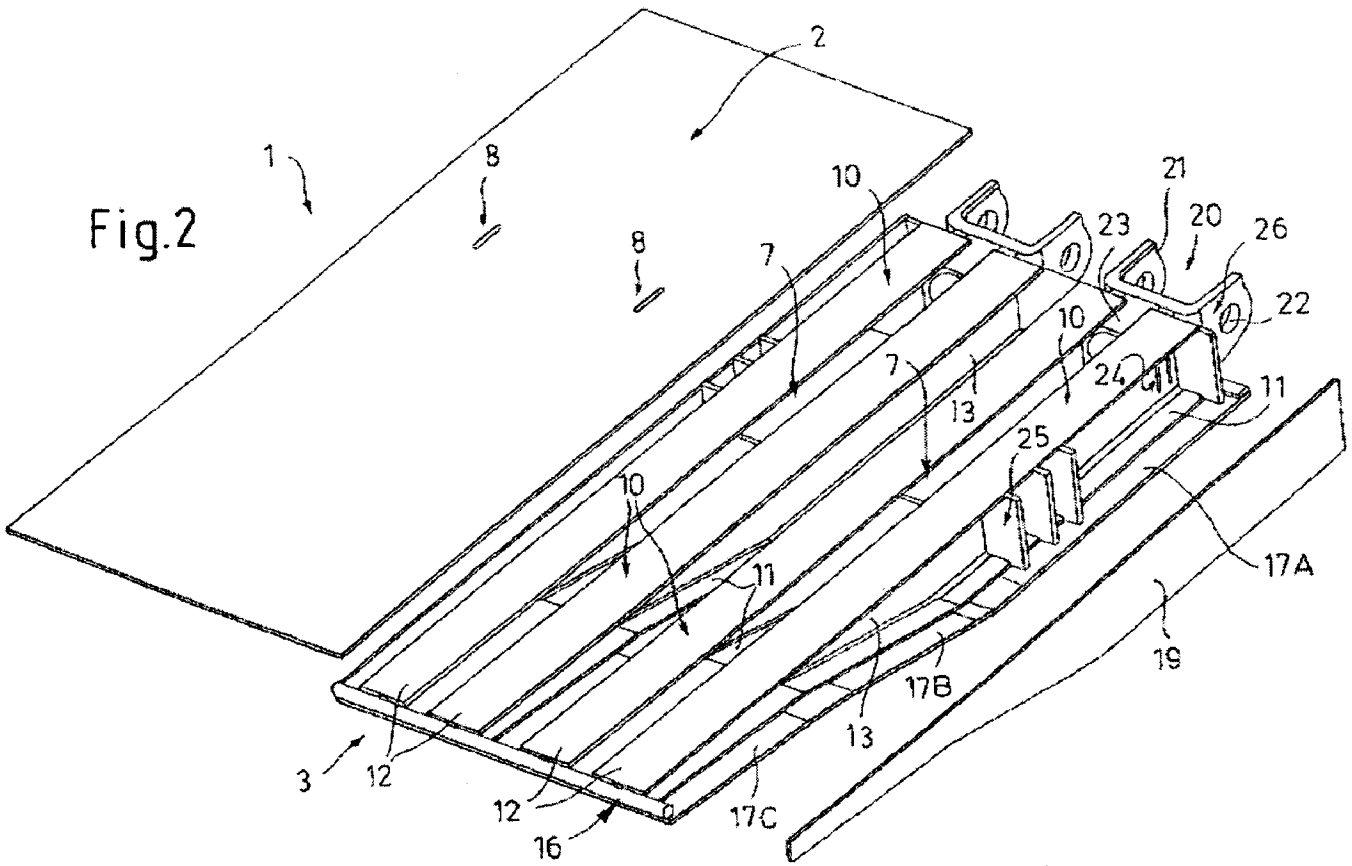
FIG. 2 shows the shield cap from FIG. 1 in perspective in an exploded illustration from above.

It is clear from FIGS. 2 and 3 that the distance A of the lower profile chord 11 from the upper profile chord 12 changes over the length of the substantially I-profile strut, there being in the rear region of the shield cap 1, over about half the length of the shield cap, a zone 14A in which the distance A is constant and the middle chord 13 has a maximum height. The zone 14A is followed by a zone 14B in which the middle chord 13 decreases relatively quickly in its height A, since the lower profile chord 11 runs at an angle of about 11° to the upper profile chord 12, this being followed by a third zone 14C in which the distance decreases to a lesser extent and in which the lower profile chord 11 runs at an angle of about 4° to the upper profile chord 12. The zone 14C ends in the freely projecting front cap end 15, to which a horizontally lying round part 16 is welded as a front closing-off element for a cavity in which the supporting structure 3 is arranged. As a result of the decreasing distance A between the two profile chords 11, 12, although the bending strength of the substantially I-profile struts 10 decreases from the rear end toward the free cap end 15, nevertheless, since the bending loads are lower in the front region than in the region of the reception devices, designated as a whole by reference symbol 4, for the cylinder heads, this construction not only saves valuable metal, in particular steel, but at the same time avoids an unnecessary increase in weight. The bending strength of the substantially I-profile struts 10 used according to the invention is at the same time considerably higher than the bending strength of a supporting structure which consists solely of box profiles or of flat sheets welded together in a box type of construction.

Figure 4:
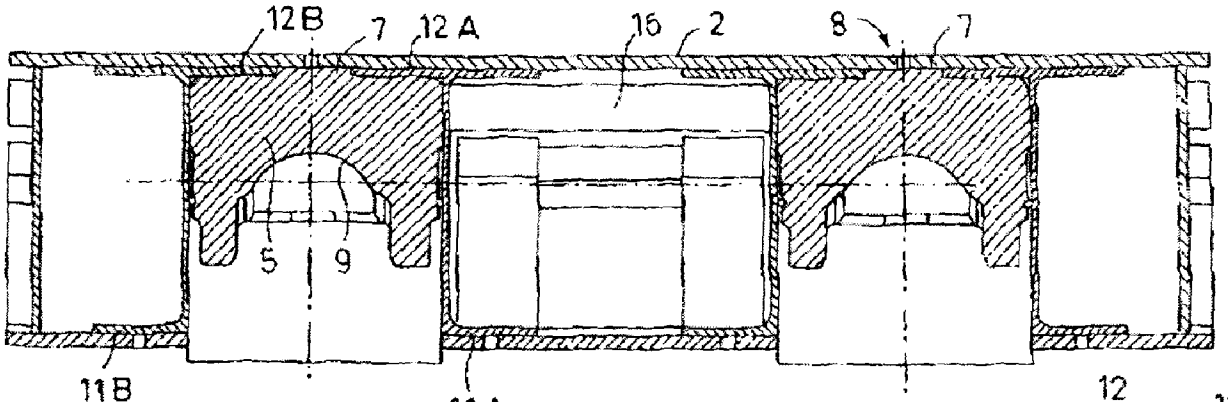
FIG. 4 shows a vertical section through the shield cap from FIG. 1 in the region of the bearing troughs.

Furthermore, the substantially I-profile struts according to the invention make it possible in a relatively simple way to fasten all the functional elements necessary for the functioning of the shield cap 1 in a shield support, such as the reception device 4 for the cylinder heads of the hydraulic rams and the pivot joints 20 for the articulated connection of the impact shield on the shield cap 1. The reception devices 4 comprise bearing troughs 5 preferably consisting of cast parts and having a block-like basic body which ends in a flat cover plate 6, via which the bearing trough 5 is welded to the underfaces of mutually confronting chord legs 12B of the outermost substantially I-profile strut 10 and 12A of the inner substantially I-profile strut 10 lying adjacently to this. As can be seen clearly from FIG. 4, the bearing trough 5 has on the rear side of the cover plate a longitudinal web 7 which is adapted to fill the interspace between the two chord legs 12A, 12B both in width and in depth. The strip 7 may bear flush against the underside of the cap plate 2, in the same way as the chord legs 12A, 12B, and the chord legs 12A, 12B are welded preferably continuously at their marginal edges to the underside of the cap plate 2. As can be seen clearly in FIGS. 2 and 4, for welding the strip 7 of the bearing troughs 5 to the cap plate 2, the latter is provided for each bearing trough with a slot 8, through which a weld seam can be applied. For the additional retention of the bearing troughs 5, the bottom plate 6 may be welded at its exposed edges to the chord legs of the upper profile chord 12. In order at the same time to provide access for the heads of the hydraulic cylinders to the bearing basins 9 in the bearing troughs 5, the lower profile chords 11 are provided, below the regions of the chord legs 12A, 12B to which the bearing troughs 5 are welded, on one side, that is to say only on the mutually confronting chord legs, with clearances which reduce the lower profile chord in this region partially to a chord leg 11B, projecting laterally on one side, on one substantially I-profile strut 11A or on the other.

Figure 6:
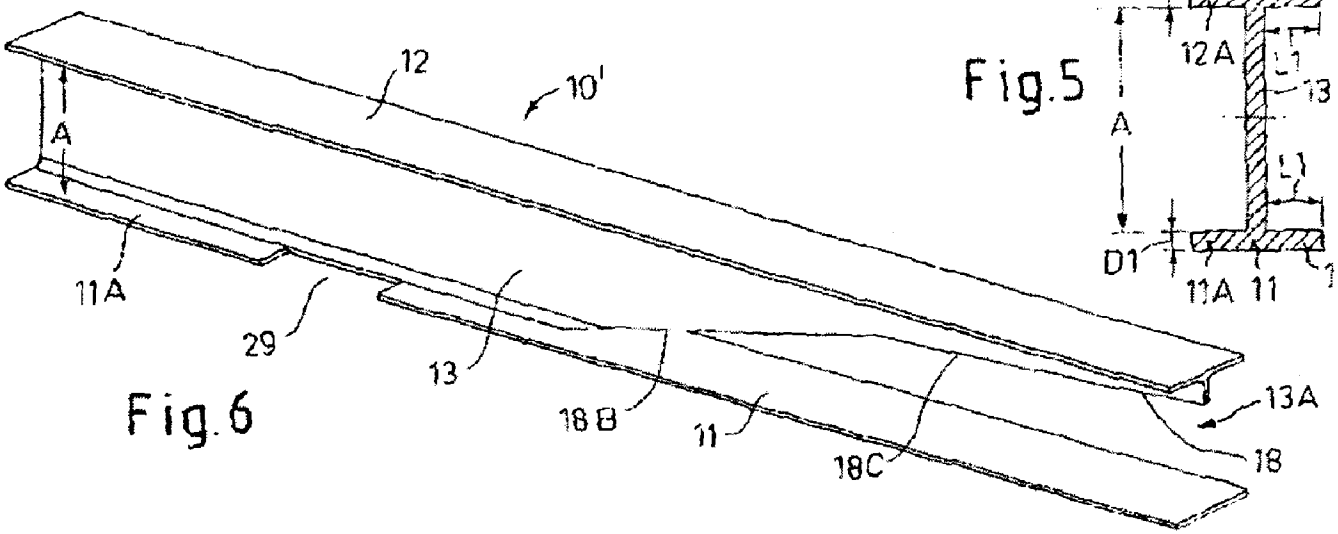
FIG. 6 shows diagrammatically the production of the substantially I-profile strut used in the shield cap according to FIGS. 1 and 2.

FIG. 6 illustrates by way of example the production of a substantially I-profile strut according to one aspect of the present invention from a rolled basic profile 10'. In the basic profile, the two profile chords 11, 12 run over the entire length of the substantially I-profile strut 10 in a straight line at a uniform maximum distance A. On account of the uniform distance of the upper profile chord from the lower profile chord 11, the middle chord 13 also has a height which is constant over the entire length of the basic profile 10'. In order, then, to produce a profile strut 10 according to the present invention from this rolled or drawn basic profile 10', a tapering portion 13A is separated out in the front region of the basic profile 10' shown in FIG. 6, in such a way that a separation edge 18 generated on the middle chord 13 by the separating out has a first zone 18B which runs at about 11° to the upper profile chord 12, and has a second zone 18C which runs at about 4° to the upper profile chord 12. The lower profile chord 11 is subsequently pressed or rolled onto this separation edge 18 and welded on via a weld seam, not shown. Although the substantially I-profile strut thereby experiences a reduction in its bending strength, nevertheless, since the reduced bending strength occurs in that region which is in any case exposed to low loads, this does not have an adverse effect. FIG. 6 also shows the cutout 29 in one chord leg 11A of the lower profile chord for access to the bearing troughs mounted on the substantially I-profile struts installed in the shield cap.

Reference is made, then, once again to FIGS. 1 to 4. Underplates 17A, 17B, 17C can be welded in a relatively simple way to the undersides of the lower profile chords 11, in order to prevent rock fragments or copious quantities of fine coal dust from being capable of penetrating to a cavity between the cap plate 2 and underplate 17A, 17B, 17C. The welding of the underplates 17A, 17B, 17C can take place through a multiplicity of longitudinal slots 30 which are positioned in such a way that, in the mounted position, they run exactly below the lower profile chord 11. Closing-off plates 19 are welded to the outsides of the outer substantially I-profile struts 10. For additional stiffening of the shield cap, the two outer substantially I-profile struts 10 may have welded to them, in each case between their outer chord legs, supporting plates 25 which run perpendicularly between the lower profile chord 11 and the upper profile chord 12 and which extend over the entire height of the middle chord 13. Closing plates 26 of identical size and dimensions may also be welded in the same way at the rear end of the shield cap 1, in which case the closing-off plates 26 and the supporting plates 25 can at the same time form the fastening webs for the side plates 19.

Before the welding of the underplates 17A, 17B, 17C and the welding of the side plates 19, pivot joints 20 are also welded in each case between two substantially I-profile struts 10, which pivot joints preferably consist of cast parts and have a substantially U-shaped portion 21 with two bores 22 for a bearing bolt for the impact shield and also a base part 23 which has an approximately rectangular cross section and the dimensions of which are adapted such that the base part 23 can be welded in between the lower profile chord 11 and the upper profile chord 12 and at the same time between the two middle chords 13 of the profile struts 10 lying next to one another. For this purpose, the profile chords 13 may be provided at the rear end with further slots 24 for applying the connecting weld seams for the base parts 23, as can be seen in FIG. 2.

FIGS. 7 and 8 show a second exemplary embodiment of the set-up of an alternative shield cap 51 according to the present invention. The shield cap 51 once again has a cap plate 52 and underplates 67, and the supporting structure of the shield cap 51 between the cap plate 52 and underplate 67 has as carrying elements four longitudinal spars, of which the inner two are formed from substantially I-profile struts 60 with a first special profile form and the outer two are formed by profile struts 90 with a second special profile form. Both in each case inner substantially I-profile struts 60 and the two outer substantially I-profile struts 90 have a lower profile chord 61 and 91 and also an upper profile chord 62 and 92 and a middle chord 63 and 93 connecting these. As in the previous exemplary embodiment, the distance from the lower profile chord 61, 91 to the upper profile chord 62, 92 changes over the length of the profile strut 60 or 90.

In the exemplary embodiment in FIG. 7, inner substantially I-profile struts 60 are used, the profile cross section of which is illustrated in detail in FIG. 8. The upper profile chord 62 of the substantially I-profile strut 60 has a here left chord leg 62A with a width L1 which is substantially shorter than the width L2 of the right chord leg 62B. The lower profile chord 61 has a left lower chord leg 61A of width L1 and a right lower chord length 61B of width L2. All the profile chords 61, 62 and also the middle chords 63 are approximately the same thickness, but the width ratio L2 to L1 is about 1.5:1 to 3:1. As shown in FIG. 7, only in the region of the bearing troughs 55 can the longer lower chord leg 61B of the substantially I-profile strut 60 be provided with a clearance which tapers this chord leg 61B to a narrow leg web 66, only in the region below the bearing troughs 55, so that the cylinder heads of the hydraulic rams can be anchored to the bearing troughs 55, with the hydraulic rams having free pivotability. The profile form of the substantially I-profile struts 60 affords, particularly in the case of shield caps having an especially wide build, a large-area support of the cap plate 52. As shown in FIG. 7, for additionally minimizing the weight, the outer substantially I-profile struts 90 are provided here in each case with outer chord legs 91A, 92A, the thickness of which is only about half as thick as the thickness of the in each case inner chord legs 92B and 91B.

FIG. 9 shows a profile strut 110 with a third possible profile cross section. The upper profile chord 112, the middle chord 113 and the lower profile chord 111 again have approximately the same thickness. The chord legs 111A projecting laterally on both sides with the same width L1 project beyond the middle leg 113 to a lesser extent than the chord legs 112A on the upper profile chord 112. The width ratio L2 to L1 may again be about 1.5:1 to about 3:1.

FIG. 10 shows a further alternative exemplary embodiment of the substantially I-profile strut 210 with a lower profile chord 211, upper profile chord 212 and middle chord 213. In each case one of the chord legs 211A, 212A has a thickness D1 which corresponds to the thickness of the middle chord 213, while the other chord leg 211B, 212B has a thickness D2 which corresponds here to double the thickness D1. The thickness ratio may lie between 1.5:1 and about 3:1.

FIG. 11 shows a substantially I-profile strut 310 with yet a further advantageous cross-sectional form. In the substantially I-profile strut 310, the upper profile chord 312 and preferably also the middle chord 313 have the same thickness D1, while only the lower profile chord 311 has a considerably greater thickness D2 which, similarly to the previous exemplary embodiment, is between 1.5 and 3 times greater than the thickness D1. The chord legs formed on both sides of the middle chord 313 are identical, and the substantially I-profile strut 310 is symmetrical to a plane of symmetry dividing the middle chord 313.

Figure 12:
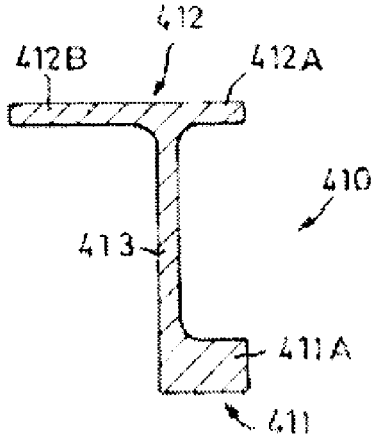
FIG. 12 shows a sixth exemplary embodiment of a profile cross section of a substantially I-profile strut.
Figure 13:
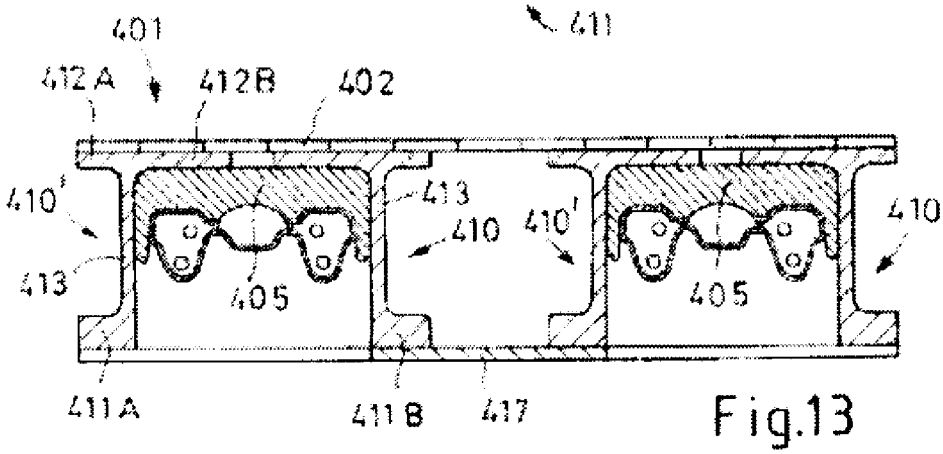
FIG. 13 shows diagrammatically a sectional view, similar to FIG. 4, through a shield cap with profile struts according to FIG. 12.

FIG. 13 shows a further exemplary embodiment of a shield cap 401 which again has a cap plate 402 and one or more underplates 417 which are stiffened by means of a supporting structure which consists essentially of four profile struts 410, 410' as longitudinal spars with a further special profile form reproduced in detail in FIG. 12. As FIG. 12 shows for the profile struts 410 and FIG. 13 also shows for the profile strut 410', all the profile struts have an upper profile chord 412 extending on both sides of a middle chord 413 and having a short chord leg 412A and a long chord leg 412B. The lower profile chord 411 extends only on one side of the middle chord 413 with a chord leg 411A, the length of which is here approximately equal to the length of the chord leg 412A which extends on the same side. As described with regard to the previous exemplary embodiments, the distance from the lower profile chord 411 to the upper profile chord 412 changes over the length of the profile strut 410. The chord leg 411A, formed only on one side, on the lower profile chord 411 has a thickness which here is approximately three times as great as the thickness of the chord legs 412A, 412B of the upper profile chord 412 and that of the middle chord 413. The greater profile thickness compensates the disadvantage of this profile form with a one-sided chord leg in terms of strength, as compared with one with a chord leg on both sides.

As shown in FIG. 13, the profile struts 410, 410' have virtually an identical set-up, the only difference being that, in the profile strut 410, the wide lower chord leg 411A projects to the right, and in the profile strut 410' it projects to the left. The profile struts 410, 410' are restored in such a way that in each case the width of a bearing trough 405 predetermines the distance between the two middle chords 413 of the profile struts 410, 410', the thick chord legs 411A being positioned in such a way that they point outward with respect to the interspace in which the bearing troughs 405 are arranged and welded. There is therefore no need for the forming of clearances or the like.

Figure 14:
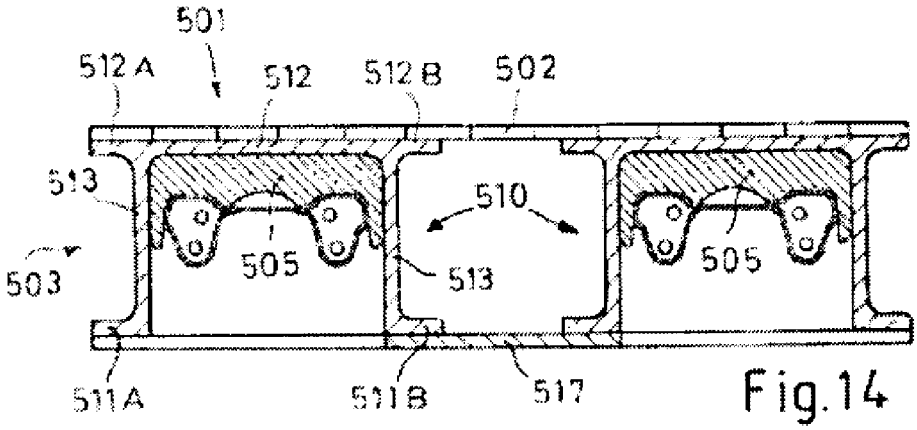
FIG. 14 shows diagrammatically a shield cap in vertical section in the region of the bearing troughs with substantially Π-profiles as longitudinal carrying spars.

FIG. 14 shows yet a further exemplary embodiment of a shield cap 501. The supporting structure 503 between the cap plate 502 and the underplate 517 consists here of only two profile struts 510 forming longitudinal carrying spars and having a special profile form which has a substantially Π-profile. From an upper profile chord 512 extending over the entire width of the profile strut 510, two middle chords 513 emanate downward, integrally formed on the latter, the distance between which corresponds to the width of the bearing troughs 505 for hydraulic cylinder heads. A chord leg 512A and 512B projects in the upper profile chord 512 and a chord leg 511A and 511B projects in the lower profile chord in each case outward beyond the middle chord 513. The chord legs 511A, 511B form the lower profile chord, to which the underplate or underplates 517 can be welded, according to the present invention the distance between the lower chord legs 511A, 511B and the upper chord legs 512A, 512B decreasing over the length of the profile struts 510. Here, no lower profile chord and no lower chord leg are located in the interspace between the middle chords 513 of each profile strut 510 of substantially Π-profile. The profile strut 510 has a uniform profile thickness in all regions.

Numerous modifications which are to come within the scope of protection of the accompanying claims may be gathered by a person skilled in the art from the preceding description. Instead of substantially I-profiles with a one-piece middle chord, two substantially U-profiles could also be combined into one substantially I-profile, in that the two middle legs of the substantially U-profiles are welded to one another. In a further exemplary embodiment, more than four substantially I-profiles could be used. The upper and, if appropriate, also lower profile chords of the substantially I-profile struts could in each case be welded to one another at the outer edges, with the result that the upper profile chords welded to one another could also form the cap plate or else could support the latter over the entire area. The lower chord legs, too, could then or in the substantially Π-profile also be connected to one another. The exemplary embodiments show only exemplary embodiments of the profile cross sections. The substantially I-profile struts could also have a portion with a constant height distance from the upper to the lower profile chord, this being followed by more than two regions running at a different angle, or being followed by only a single portion with an oblique run of the profile chords with respect to one another. This oblique run could have a constant slope angle or could also be slightly curved. A curvature and/or a plurality of anglings may bring about an additional stiffening of the substantially I-profile strut. The oblique/curved region preferably extends, in turn, as far as the front end of the profile strut. In a shield cap, the substantially I-profile struts shown could also be combined with one another and installed as a supporting structure, depending on the intended use.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

The invention claimed is:

1. A shield cap for a shield-type support for underground mining comprising:

a cap plate including reception devices for the connection of hydraulic cylinder heads to the shield cap and a supporting structure welded below the cap plate and having a plurality of longitudinal spars, wherein at least two of the longitudinal spars include substantially I-profile struts, each strut having an upper profile chord, a lower profile chord and a middle chord running perpendicularly to the two profile chords, a distance between the upper and the lower profile chord decreasing at least over a part length of each strut.

2. The shield cap as claimed in claim 1, wherein the upper profile chord and the lower profile chord extend on both sides of the middle chord in each case with a chord leg.

3. The shield cap as claimed in claim 1, wherein the upper and the lower profile chord have width and thickness dimensions identical to one another.

4. The shield cap as claimed in claim 1, wherein the upper and the lower profile chord have at least one of different width dimensions and different thickness dimensions.

5. The shield cap as claimed in claim 1, wherein the I-profile strut is configured to be mirror-symmetrically to a longitudinal mid-plane of the middle chord.

6. The shield cap as claimed in claim 1, wherein chord legs of at least one of the upper profile chord and the lower profile chord on one side of the middle chord have at least one of a greater thickness and a greater width than chord legs on the other side.

7. The shield cap as claimed in claim 6, wherein the lower chord legs are provided partially with clearances in the region of the reception devices for the hydraulic cylinder heads.

8. The shield cap as claimed in claim 7, wherein the clearances extend as far as the middle chord.

9. The shield cap as claimed in claim 7, wherein the clearances reduce the width of the chord leg of the lower profile chord to a leg web.

10. The shield cap as claimed in claim 1, wherein the lower profile chord extends only on one side of the middle chord with a lower chord leg, the thickness of the lower chord leg being greater than the thickness of the middle chord and the thickness of upper chord legs of the upper profile chord.

11. The shield cap as claimed in claim 1, wherein two profile struts are combined into a longitudinal carrying spar of a substantially Π-profile (pi-profile), wherein the substantially Π-profile spar is defined by upper profile chords of two profile struts being welded to one another or two middle chords spaced apart from one another by the amount of an interspace being provided integrally on an upper profile chord.

12. The shield cap as claimed in claim 1, wherein the upper profile chords of all the profile struts are welded to the underside of the cap plate via longitudinal weld seams.

13. The shield cap as claimed in claim 1, wherein four longitudinal spars including substantially I-profile struts are provided.

14. The shield cap as claimed in claim 1, wherein the reception device comprises a bearing trough which is welded to mutually confronting chord legs of adjacent profile struts, the bearing trough having on the rear side a cover plate with a longitudinal web which is adapted to fill an interspace between the two chord legs.

15. The shield cap as claimed in claim 1, wherein pivot joints including cast parts are welded to the rear end of the shield cap, the pivot joints having a base part which is welded in between the upper and the lower profile chord of adjacently lying profile struts.

16. The shield cap as claimed in claim 1, wherein the middle chord of the profile strut has a zone of constant height, a zone with a higher gradient and a zone with a lower gradient.

17. The shield cap as claimed in claim 16, wherein the zone of constant height of the middle chord is about twice as long as the other two zones of changing heights in each case.

18. The shield cap as claimed in claim 1, wherein the profile struts are produced from one of a cast, drawn or rolled basic profile with a constant distance between the upper and the lower profile chord, in which the middle chord is partially separated in the lower region, a portion of the middle chord is separated out and the lower profile chord is one of pressed or rolled onto a separation edge and welded on.

19. The shield cap as claimed in claim 1, wherein supporting plates are welded in between the chord legs of the upper and the lower profile chord.

20. The shield cap as claimed in claim 1, wherein at least one underplate provided with longitudinal slots for the application of connecting weld seams is welded to the underside of the lower profile chord.

21. The shield cap as claimed in claim 20, wherein a plurality of underplates are welded to the underside of the lower profile chord, the plurality of underplates being distributed over the length of the lower profile chord.

* * * * *